US006182365B1

(12) United States Patent
Tseng et al.

(10) Patent No.: US 6,182,365 B1
(45) **Date of Patent: *Feb. 6, 2001**

(54) SKIN ENGAGING MEMBER FOR RAZOR BLADE ASSEMBLY

(75) Inventors: Mingchih M. Tseng, Hingham; Philip J. Sweeney, Taunton; Alfred Porcaro, Everett; Domenic Apprille, Arlington, all of MA (US)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/906,275

(22) Filed: Aug. 5, 1997

Related U.S. Application Data

(63) Continuation of application No. 08/893,969, filed on Jul. 16, 1997, now abandoned, which is a continuation of application No. 08/806,587, filed on Feb. 26, 1997, now abandoned, which is a continuation of application No. 08/461,319, filed on Jun. 20, 1995, now abandoned, which is a continuation-in-part of application No. 08/269,494, filed on Jul. 1, 1994, now abandoned.

(51) Int. Cl.[7] ..... B26B 21/08; B26B 21/40

(52) U.S. Cl. ..... 30/34.2; 30/50; 30/82; 30/83

(58) Field of Search ..... 30/34.2, 41, 77, 30/81–83, 50

(56) References Cited

U.S. PATENT DOCUMENTS 5,249,361 * 10/1993 Apprille et al. ..... 30/77

FOREIGN PATENT DOCUMENTS 2119747 1/1993 (CA) .

* cited by examiner

*Primary Examiner*—Douglas D. Watts
(74) *Attorney, Agent, or Firm*—Fish & Richardson P.C.

(57) ABSTRACT

The present invention relates to a skin engaging member for use in a razor blade cartridge assembly or shaving systems of the wet shave type comprising an elongated flexible sheath region and at least one elongated, rigid core region. The core region is surrounded by the sheath such that the outer surface of the core does not intersect the outer surface of the sheath. Generally, the core or cores extend axially throughout the sheath and provide sufficient mechanical strength and rigidity to provide adequate mechanical strength and rigidity to provide adequate mechanical strength to the entire skin engaging member, as initially produced, during the shaving operation and after a significant amount of shaves.

10 Claims, 6 Drawing Sheets

SKIN ENGAGING MEMBER FOR RAZOR BLADE ASSEMBLY

This application is a continuation of U.S. Ser. No. 08/893,969 filed Jul. 16, 1997 abandoned, which is a continuation of U.S. Ser. No. 08/806,587, filed Feb. 26, 1997, now abandoned, which is a File Wrapper Continuation of U.S. Ser. No. 08/461,319, filed Jun. 20, 1995, now abandoned, which is a Continuation-in-Part of U.S. Ser. No. 08/269,494, filed Jul. 1, 1994, now abandoned.

BACKGROUND OF THE INVENTION

This invention relates to an improved skin engaging member for use in razor blade cartridge assemblies or shaving systems of the wet shave type. The present invention resides broadly in providing a skin engaging cap and/or guard surfaces with configurations or textures designed to promote pleasant tactile sensations, in use of the razors, which tend to mask the sensations caused by contact of the blade edge(s) with the skin and more significantly with the facial hairs as they are severed. This invention also relates to a novel method of manufacturing the skin engaging member of the present invention

DESCRIPTION OF THE PRIOR ART

It is known in the prior art to provide a razor blade assembly which may be connected to and used in conjunction with a razor handle to facilitate shaving operations. In U.S. Pat. No. 3,724,070, issued Apr. 3, 1973, in the name of Francis W. Dorion, Jr., there is shown a blade assembly in which blade means are held between the blade assembly surfaces adapted to engage the surface being shaved in front of and behind, respectively, cutting edge portions of the blade means. Such surfaces are generally referred to in the prior art as "guard" and "cap" surfaces.

In various blade assemblies shown in the prior art the guard, cap and blade means have been disclosed in various forms. In order to increase shaving efficiency, in some instances, the individual components have been designed to move in response to forces encountered during shaving. In U.S. Pat. No. 4,168,571, issued Sep. 25, 1979, in the name of John F. Francis, there is shown a blade assembly in which the guard, cap and blade means are each movable independently of each other in dynamic fashion. U.S. Pat. No. 4,270,268, issued Jun. 2, 1981, in the name of Chester F. Jacobson, shows a blade assembly in which the guard and blade means are independently movable. Various other patents show a combination of guard, blade. and cap arrangements which are known, for instance U.S. Pat. No. 4,270,268, U.S. Pat. No. 4,488,357, U.S. Pat. No. 4,492,024, U.S. Pat. No. 4,492,025, U.S. Pat. No. 4,498,235, U.S. Pat. No. 4,551,916, U.S. Pat. No. 4,573,266, U.S. Pat. No. 4,586,255, U.S. Pat. No. 4,378,634, U.S. Pat. No. 4,587,729, and U.S. Pat. No. 4,621,424, all issued in the name of Chester F. Jacobson and assigned to the assignee of the present invention.

Further, in U.S. Pat. No. 5,191,712 issued Mar. 9, 1993, in the name of Crook et al. there is disclosed a molded skin engaging guard surface to be employed in the manner of guard surfaces disclosed in the above-referenced patents, which is designed to promote pleasant tactile sensations in the use of the razor and which tend to mask the sensations caused by contact of the blade edges with the skin and more significantly the facial hairs as they are severed. In the various embodiments of the referenced U.S. Pat. No. 5,191,712, the skin engaging surfaces are provided, in one form or another with projections, arrayed in a substantial number so that forces between projections and the skin are widely distributed among the projections. In some embodiments, the surface configurations are provided by discrete filaments, fins or upstanding walls which are yieldable in use because of their inherent flexibility. In the manufacture of the guard surface, it is therefore essential that a material be employed which is capable of providing the flexibility in the projecting elements to product the proper yielding under usage.

Still further, in U.S. Pat. No. 5,249,361 issued Oct. 5, 1993, Apprille et al disclose a two-part, molded "guard" structure having an upper skin engaging portion of elastomeric material with a plurality of upwardly projecting protrusions formed thereon and a lower base portion of rigid plastic material having a downwardly projecting V-shaped cross-sectional portion. A pair of upwardly projecting elements are disposed in spaced relation forming a recess on the blade cartridge structure for receiving the V-shaped base portion there between and a latch means disposed in the recess retains the guard member in the assembled position. Molded articles of this kind require a large capital investment to provide 2-component mold tools for their manufacture.

While the construction of the guard surface containing the flexible elements may be accomplished by the proper choice of material to produce the yieldable members, it is also necessary that the guard be mounted onto the razor blade body structure, whether it be a one-piece razor, disposable razor, replaceable cartridge. In that the material chosen for the yieldable elements is not generally such that it would be possible to form the guard as an integral part of the razor blade body structure. It is preferable that the guard be constructed as a separate unit. Further, as a separate unit, the yieldable material is not adaptable to attachment into the razor blade body structure, in its elongated form, without providing substantial support to produce proper positioning of the guard during usage of the razor blade body structure and for permanent retention of the guard within the razor blade body structure.

It is therefore an object of the present invention to provide a skin engaging member to be employed in a razor blade body structure which is simple to manufacture and supplies ease of permanent installation into the razor blade body structure.

Another object of the present invention is to provide a skin engaging member to be employed in a razor blade body structure which exhibits sufficient rigidity to endure the rigors of high speed razor assembly operations and still retain the surface stability required to produce effective skin engagement.

Yet another object of the present invention is to provide a high speed process for manufacturing a skin engaging member which requires a low capital investment, and low maintenance costs.

These and other objects of the present invention will be evident from the following:

SUMMARY OF THE INVENTION

The present invention relates to a skin engaging member for use in a razor blade cartridge assembly or shaving system of the wet shave type comprising an elongated flexible sheath region and at least one elongated, rigid core region. The core region is surrounded by the sheath such that the outer surface of the core does not intersect the outer surface of the sheath. Generally, the core or cores extend axially throughout the sheath.

BRIEF DESCRIPTION OF THE DRAWINGS

FIGS. 7–8 and 14 are perspective views of alternate skin engaging surfaces according to the present invention.

DESCRIPTION OF THE PREFERRED EMBODIMENTS

As used herein, the term "core" refers to a central portion of a skin engaging member as examined at the cross-section. The Fig's. designate the core as 13. Embodiments of the present invention have at least one core element. Also, as used herein a "rigid core" has sufficient mechanical strength and rigidity to provide adequate mechanical strength to the entire skin engaging member, both as initially produced, during the shaving operation and after a significant amount of shaves.

As used herein, the term "sheath" refers to an outer coating layer or layers over the core material 13. The Fig's. designate sheath as 14.

Figure 1:
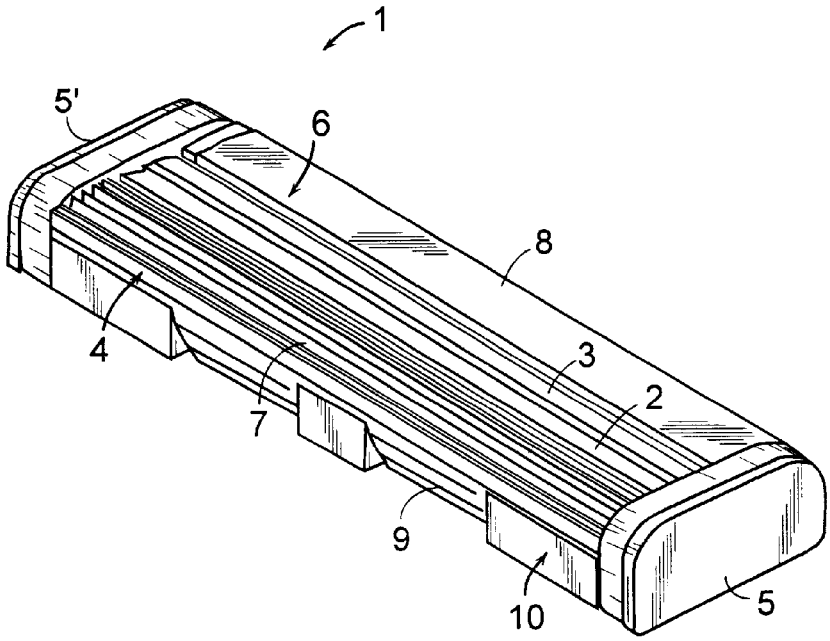
FIG. 1 is a perspective view of a shaving system of the wet shave type to which the invention may be applied.

Referring now to the drawings, and in particular to FIG. 1, there is shown an elongated razor cartridge assembly 1. Commercial razor blade cartridges of this type are common in the market place. These commercial cartridges comprise one or more blades 2, 3 and a rigid body structure 10 comprised of a lower base member 9 and two end units 5 and 5'. Affixed to the body depicted are two razor blades 2 and 3. It is common for these blades to be supported on the springs or other movable members which allow the blade edge to conform to the contours of the face. Anterior to the leading edge of the blades is found the guard assembly 4 and posterior to the leading edge of the blades is the cap assembly 6. It is on the guard and/or cap members that the skin engaging surface 7 and 8 of the present invention may be positioned, respectively.

Figure 2:
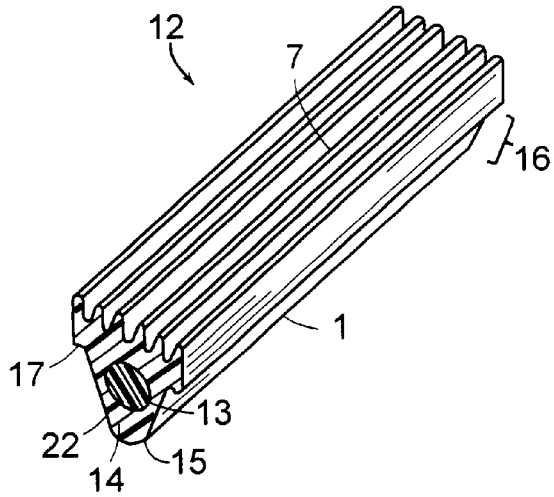
FIG. 2 is a perspective view of a skin engaging member according to the present invention.

Referring now to FIG. 2, there is shown an elongated skin engaging member 12 which is a unitary molded member formed of a rigid or semi-rigid core material 13 and a flexible sheath material 14. The skin engaging member 12 is formed of a bottom base 15 having a substantially V-shaped cross section portion 16 extending downwardly and a forwardly projecting platform 17 at the rear of the engaging member 12. The V-shaped cross section terminates in a downwardly directed rear support surface 18. At the top of the skin engaging member is the skin engaging surface 7. In the embodiments of FIGS. 2–6, the skin engaging surface 7 comprises a plurality of protrusions in the form of conical cross section ribs 20 ascending upwardly and substantially over the length of the guard member 12 being spaced one from another on the skin engaging surface 7. The elongated skin engaging member 12 is formed by an extrusion or co-extrusion process designed to incorporate materials with different characteristics as the core member 13 and sheath member 14.

The sheath member 14 is substantially chosen to provide a flexibility in the ribs 20 found necessary to provide the preferred tactile sensation during the shaving process. The sheath material may be hydrophobic or a hydrophobic material. The sheath must be a soft material. Preferably the sheath material is a thermoplastic material, elastomeric material or combination thereof. The sheath material can be any thermoplastic elastomer selected from the following groups:

styrene elastomers, e.g. SEBS, SBS or SEBS/PPE; polyolefin elastomers, e.g. PP/EPDM, PP/EPDM crosslinked, PP/IIR crosslinked, PP/NR crosslinked or PP/NBR crosslinked; polyamide elastomer, e.g. PA 12-based polyester or PA-6 based; elastomers, e.g. polyesterester or polyesterester; or polyurethane elastomers, e.g. polyester urethane, polyetheresterurethane or polyether urethane.

In order to produce the desired flexibility, the materials are chosen to have a hardness in the range of 27 to 75 on the Shore A scale. Materials which may be selected are Krayton G7705, a styrene-ethylene/butylene-styrene block copolymer manufactured by Shell Corporation, Evoprene G966, a styrene-ethylene/butylene-styrene block copolymer manufactured by EVODE Plastics Ltd., Leicester, England and distributed by Gary Chemical Corporation of Leominster, Massachusetts, Santoprene 271-55 thermoplastic rubber (cross-linked EPDM in polypropylene) and Santoprene 271-73 thermoplastic rubber (cross-linked EPDM in polypropylene) both manufactured by Advanced Elastomerics Corporation, C-Flex thermoplastic elastomer (styrene-ethylene/butylene-styrene block copolymer with polydimethisiloxane, polypropylene, mineral oil, antioxidant and other modifiers) manufactured by Concept Polymer Technologies. Inc., Clearwater, Fla., and Sarlink 2160 blend of polypropylene and butyl rubber and ethylene vinyl acetate, polypropylene/butyl rubber blends, polyamide/elastomer block copolymers, polyurethane/elastomer block copolymers, ethylene vinyl acetate; Sarlink 2160, 2170 or 2180 brand polypropylene-based elastomer, manufactured by DSM; Vyram brand elastomer, manufactured by Advanced Elastomer Systems; Catalloy brand elastomer; Forprene brand cross-linked PP/EPDM; or polyester/elastomer block copolymers. The sheath may also be made of composite materials such as: a blend of 50% (wt) C-Flex/50% Santoprene 281-45; 25% calcium carborate-filled polypropylene or a blend of 95% ethylene vinyl acetate/5% polyethylene oxide; 50% PEBAX 2533 (polyether block amide, manufactured by Atochem North America Inc.)/ 50% KRATON G2706.

The sheath may include additional components such as: plastisizers, such as polyethylene glycol; beard softeners, such as Kraton G 13 A; lubricants, such as silicone oil, Teflon® polytetrafluoroethylene powders (manufactured by DuPont), waxes, and polyethylene oxide; shaving aids, such as menthol, eugenol, eucalyptol, safrol and methyl salicylate; fillers, such as calcium carbonate, microspheres, mica and fibers; tackifiers such as Hercules Regalrez 1094 and 1126; fragrances; antipruritic/counterirritant materials such as Frescolat; antimicrobial/keratolytic materials such as Resorcinol; anti-inflammatory agents such as Candilla wax and glycyrrhetinic acid; astringents such as zinc sulfate;

surfactants such as pluronic and iconol materials; compatibilizers such as styrene-b-EO copolymers; and, blowing agents such as Uniroyal Celogen Aznpl30. These additives may leach from the surface to provide improved shaving. These components could be dispersed throughout the sheath or alternatively, a second, outer sheath containing the additional element could be extruded ore merely coated over the primary sheath.

The core material 13 is required to provide rigidity over the length of the elongated guard member 12 and therefore, a rigid material or semi-rigid material is generally chosen both for support of the more flexible upper sheath portion 14 and to cooperate with elements on the razor blade body 10 and elements on the manufacturing equipment required to produce commercial cartridges. Core materials must have sufficient mechanical strength and rigidity to provide adequate mechanical strength to the entire skin engaging member, both as initially produced, during the shaving operation and after a significant amount of shaves. Preferred core materials are Amoco 1012 polypropylene manufactured by Amoco Chemical Inc., high impact polystyrene, metal wire, nylon, PET, polyethylene, polystyrene, acetal resins, fibers, yarns and combinations thereof. While a number of rigid materials may be employed, it is found that a more stable member is produced when the core and sheath materials have some degree of chemical compatibility. Accordingly, the preferred core material is high impact polystyrene, also known as Huntsman polystyrene which is a rubber modified polystyrene thermoplastic polymer, CAS Registry No. 9003-55-8, manufactured by Huntsman Chemical Corporation, Chesapeake, Va.

Applicant has discovered that by encapsulating the core in a sheath material, disparate materials with vastly different stiffness characteristics can be utilized effectively. When a skin engaging surface is molded on top of a rigid base member as shown in U.S. Pat. No. 4,249,361, there is a higher likelihood of delamination of the surface layer. By encapsulating the cross-section of the core in the flexible sheath material, applicant can produce a stable skin engaging member. Furthermore the core/sheath embodiment is effectively produced with a co-extrusion or extrusion type of an apparatus. This type of manufacturing is much lower in capital investment compared to the 2-component molding unit which would be required for the embodiment in reference to U.S. Pat. No. 5,249,361.

Figure 3:
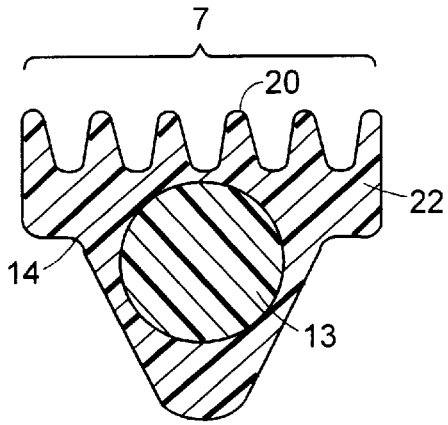
FIG. 3 is an end cross-sectional view of the skin engaging member of FIG. 2.
Figure 4:
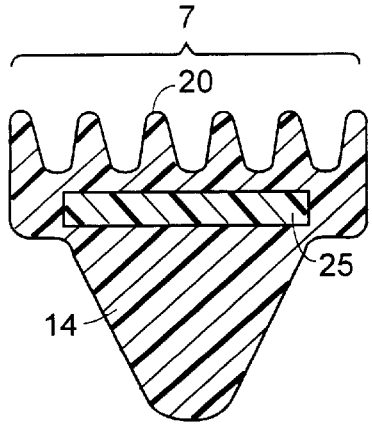
FIGS. 4–6 are end views of alternate skin engaging members according to the present invention.
Figure 5:
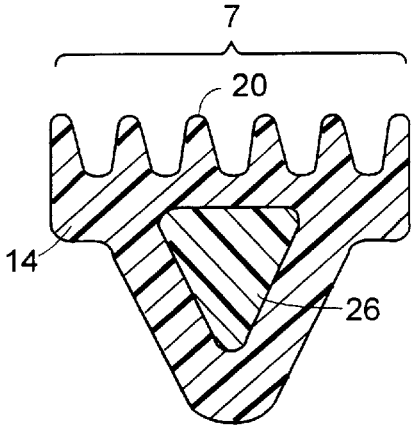
Figure 6:
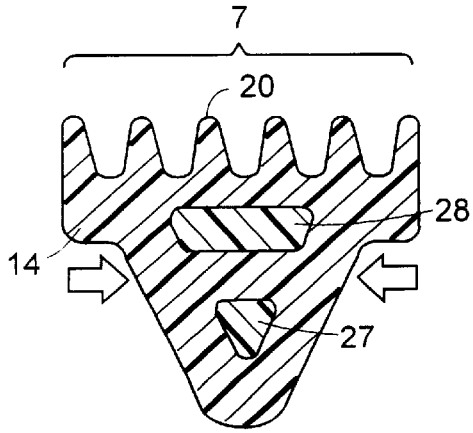

Referring now to FIGS. 2–6, the present members are further characterized by their texturized cross sectional surface representation. When a cross section is taken transverse to the axis of the core material, the unique end view 22 is provided. These end views clearly depict the skin engaging surface 7, the conical rib members 20 and the positioning of the core member 13. In FIG. 3, a cylindrical core member, depicted by a circular cross section is utilized. The cylindrical core typically has a diameter of from about 0.040 inches to about 0.053 inches. FIG. 4 shows a rectangular core member 25. Such a core member would provide improved stability to the skin engaging surface 7. FIG. 5 shows a triangular core member 26. A triangular core which compliments the V-shaped contour 16 of the skin engaging member and enhances the overall stability of the unit during high speed cartridge assembly processes. Finally, FIG. 6 depicts a dual core system. Applicants contemplate multiple core systems. Skin engaging members which utilize 2, 3, 4 or more cores are considered within the scope of the present invention. In FIG. 6, a dual core system is utilized which also serves as a mechanical lock to hold the skin engaging member into the cartridge body. The lower core 27 is allowed to penetrate deep within the body of the cartridge 10. Pincers or mechanical lock mechanisms which are depicted by the horizontal arrows are allowed to squeeze the resilient sheath material found in the locking region 28. Secondary core material 28 serves as a bumper to prevent the mechanical lock from penetrating too deep into the upper regions of the skin engaging member.

Figure 7:
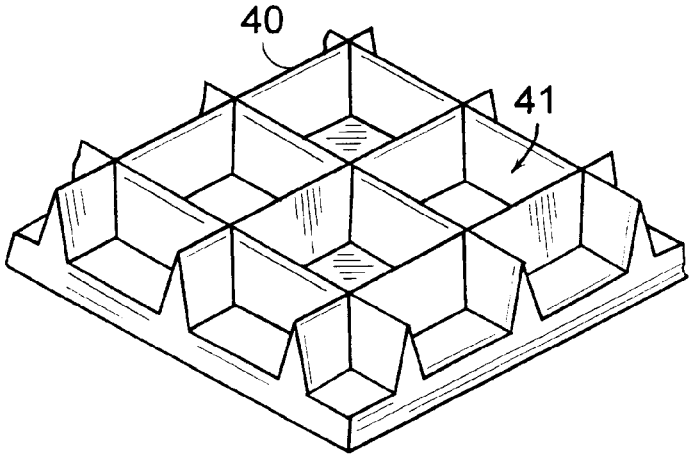
Figure 8:
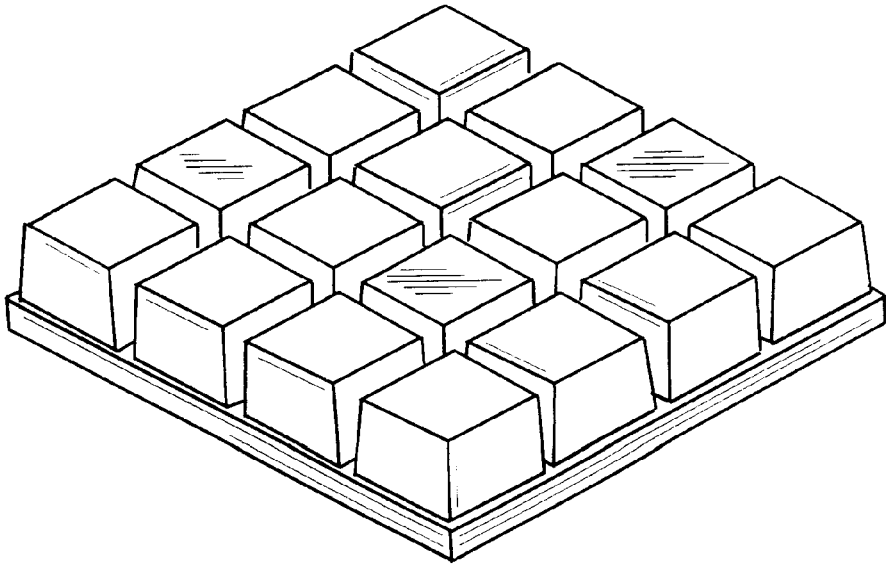

The present invention is not limited to simple skin engaging surface topologies such as longitudinal ribs or flat surfaces. As shown in FIGS. 7 and 8, the skin engaging surface of the present invention may be any topology. FIGS. 7–8 show more complicated patterns produced using an extrusion line which also includes a texturizing wheel 30. (See FIG. 10). A waffle-like skin engaging surface is depicted in FIG. 7. The surface is comprised of transverse and longitudinal ribs which provide a surface of squared nubs separated by substantially rectangular-shaped valleys. Other surfaces produced using the extrusion line including the texturizing wheel comprised a network of dimples, transverse and longitudinal grooves.

The skin engaging members of the present invention 12 are affixed to the body of a razor blade cartridge by any suitable chemical, thermal or mechanical means. Preferably the members are affixed with a glue, such as Loctite Super Bonder 499, and Loctite Prism Primer 770, manufactured by Loctite Corp. or via a mechanical mechanism similar to those described in FIG. 6 or in U.S. Pat. Nos. 4,573,266; 4,586,255, 4,987,729; 4,621,424 or 5,056,222 incorporated herein by reference. Other mechanical embodiments could be utilized such as providing clip holders and locking members into the upper region of the member 35. These modifications are less desirable, but still within the scope of the present invention since they would require an additional processing step after they are manufactured via extrusion.

Figure 9:
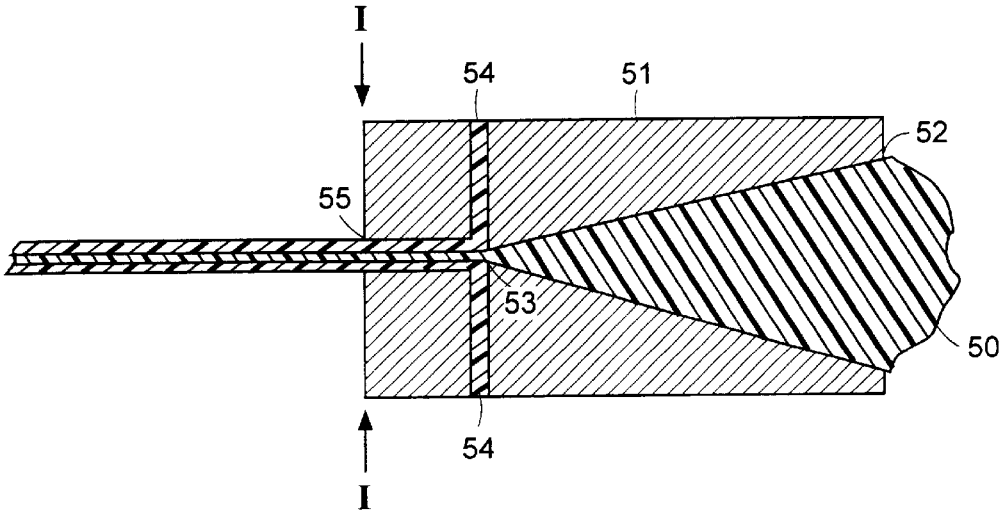
FIG. 9 is a longitudinal cross-section down the core axis of an extrusion die head suitable for use in manufacturing the present invention.
Figure 11:
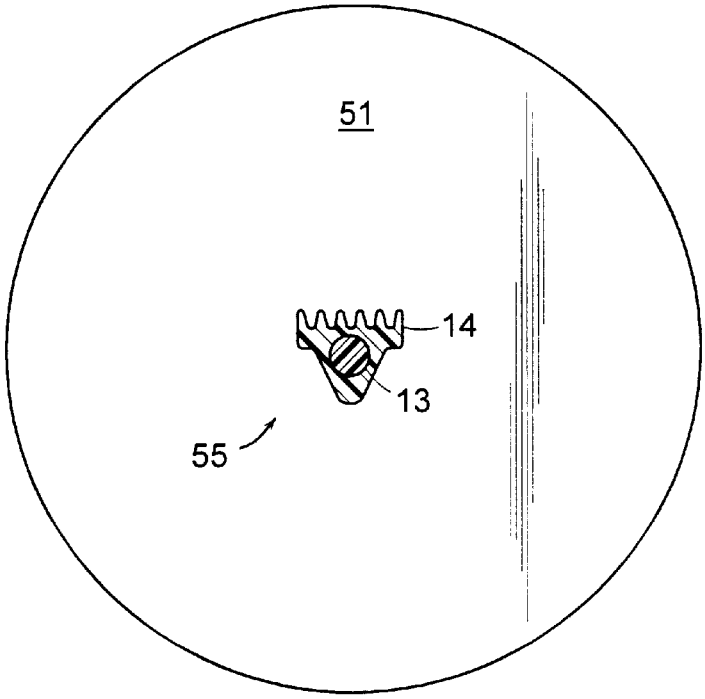
FIGS. 11–12 are end views, i.e. exit ports of extrusion dies for manufacturing the present skin engaging member.
Figure 12:
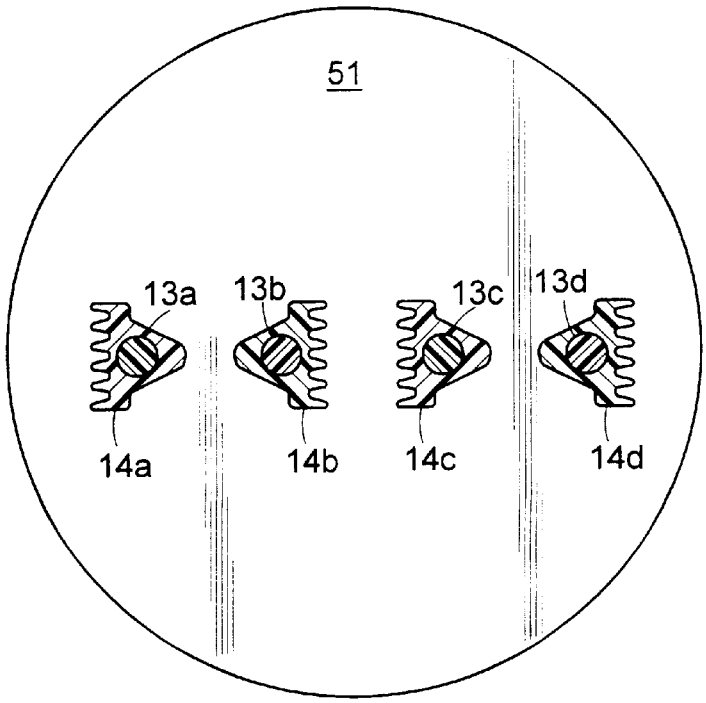

FIG. 9 is a schematic cross sectional diagram of an extrusion die suitable for manufacturing the skin engaging members of the present invention. Core material 50 is fed into the extrusion die 51 by an extrusion screw, hot melt or other suitable means. In the core inlet port 52, the tight core orifice 53 encounters the sheath material wherein the core becomes encapsulated by the sheath material when viewed in a transverse cross section to the flow of the die materials. The encapsulated core then proceeds to the die outlet 55 wherein the continuous skin engaging members can be cured and/or drawn down to provide the appropriate dimensions. Also, it should be noted that the core material could consist of a solid wire or solid plastic material which is fed in through a conventional die which produces a encapsulated skin engaging member. This is commonly referred to as a wire-coating extrusion process. For a general discussion of co-extrusion technology see Levy, *Plastics Extrusion Technology Handbook,* Industrial Press Inc., pages 168–188 (1981), incorporated herein by reference. FIG. 11 is an end view of the segment I—I. The core 13 and the sheath 14 closely resemble the finished product. A more complicated die is shown in FIG. 12 wherein four continuous skin engaging members are produced. After the continuous grouping of skin engaging members are produced, they are sent for further processing where they typically are drawn-down to the correct size and cut to length suitable for implant into the body of a razor blade cartridge. This cutting can be achieved by knife-edge cutting, lasers, or water lasers. The skin engaging surfaces 7 and/or 8 of the present invention typically are rectangular in shape with a width of about 0.163 inches and a length of about 1.337 inches and an overall height of about 0.149 inches.

Figure 10:
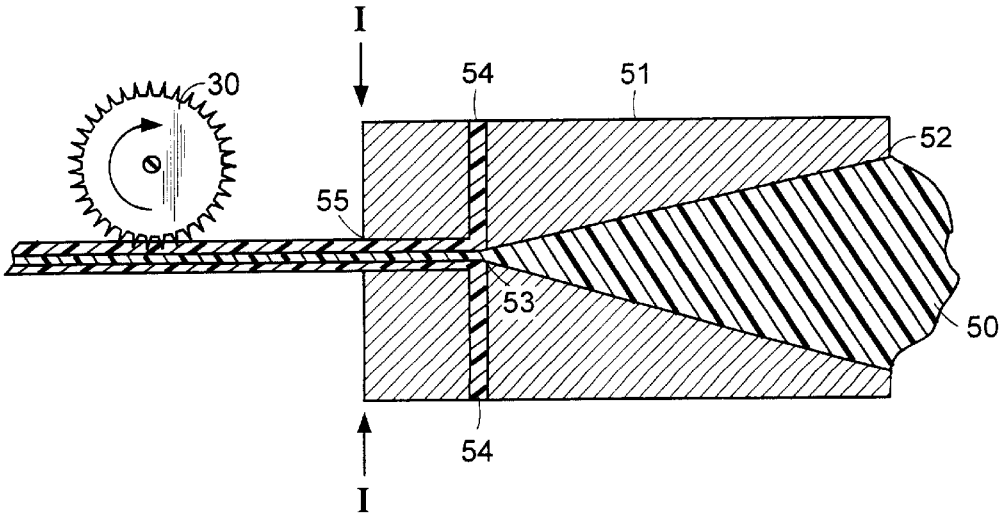
FIG. 10 is a cross-sectional view of a die head with a texturizing wheel for producing a skin engaging member with a texturized surface as in FIGS. 7 and 8.

FIG. 10 shows a schematic longitudinal cross section similar to that of FIG. 9 with additional texturing wheel component 30. The wheel has a complimentary texturized surface which rolls over the semi-cured or uncured sheath material, thus providing complicated texturized patterns like the ones shown in FIGS. 7 and 8. Often the continuous skin engaging member 58 is supported 57 during the texturizing operation. A texturizing wheel of this type may additionally be heated and/or coated with a mold-release agent.

Figure 13:
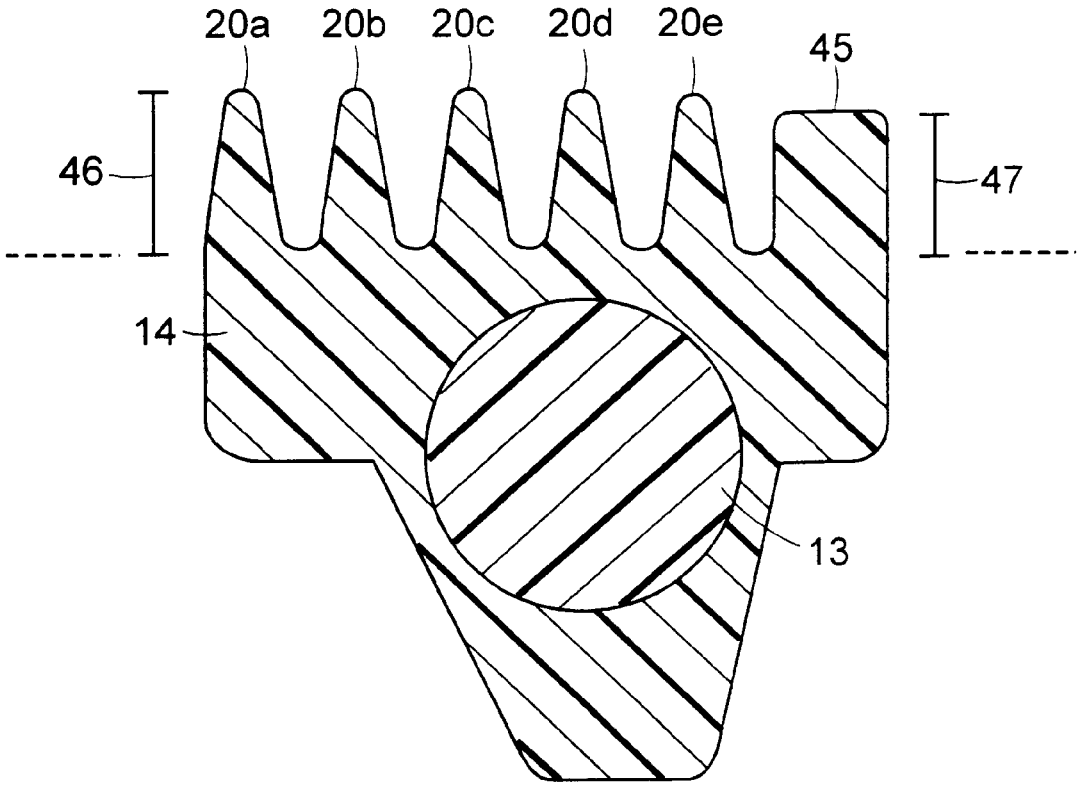
FIG. 13 is an end view of the most preferred skin engaging member embodiment.

Finally, FIG. 13 is a cross-sectional, end view of the most preferred skin engaging member embodiment. This skin engaging member is positioned on the guard of the razor as shown in FIG. 1. The skin engaging member has five conical fin ribs, 20*a*, 20*b*, 20*c*, 20*d* and 20*e*, and a substantially rectangular guard rib 45 positioned distal to the razor blade edge. The conical ribs preferably have a height 46 of about 0.025 inches and the guard rib is slightly shorter than the fin ribs, typically about 0.020 inches.

Applicant considers equivalent embodiments to be part of the present invention. For example, non-rectangular skin engaging surface areas may be utilized (such as ovals) and alternate surface patterns could be utilized are also contemplated by the present invention. The invention and manner of making and using the invention will be more fully appreciated from the following non-limiting examples.

EXAMPLES

The following samples were co-extruded with a cross section as in FIG. 2. Postextrusion, draw-down ratio was maintained at 5:1 or less. Drawn-down diameters of the core were 0.046±0.001 inches.

| No. | Core Material | Sheath Materials |
|---|---|---|
| 1 | Filled Propylene | C-Flex |
| 2 | 25% $CaCO_3$ filled Polypropylene | C-Flex |
| 3 | Polypropylene | C-Flex |
| 4 | 15% $CaCO_3$ Filled Polypropylene | C-Flex |
| 5 | High Impact Polystyrene | Evoprene |
| 6 | Polypropylene | ethylene vinyl acetate |
| 7 | Polypropylene | Santoprene |
| 8 | High Impact Polypropylene | Santoprene |
| 9 | Polypropylene | Santoprene |
| 10 | Zytel 330 (amorphous nylon, mfg by DuPont) | 50% Polyox, 25% Zytel, 25% EVA 360 |
| 11 | High Impact Polystyrene | C-Flex |
| 12 | High Impact | 95% EVA 5% Polyethylene oxide |
| 13 | polystyrene | Pellethane 2130-70A (mfg by Dow Chemical) |

Example 14

The following procedure can be used to produce a skin engaging member with the cross section of FIG. 13:

The extrusion equipment includes two single-screw extruders, a die cross-head, a cooling channel, and a puller. The strip extruded from the extruders was pulled through a cooling tunnel by a Farris puller (a take-off machine) at a speed of approximately 10 feet per minute with minimum tension on the strip. The strip was air-cooled by blowing dry compressed air into the tunnel at approximately 10 CFM. If no water soluble material is used, the strip could also be water-cooled The core material (100%) high impact polystyrene) is extruded through the first ¾ Haake extruder (barrel pressure of 398 PSI and temperature of 170°–190° C.). The sheath material (C-Flex TPE) is extruded through the second ¾" Haake extruder (barrel pressure of 385 PSI and temperature of 140°–160° C.). The two materials then join and are fed through a cross-head at a temperature of 180° C. to form a continuous fin guard strip. The line speed is approximately 10 FPM.

What is claimed is:

1. A razor cartridge comprising a blade and an elongated polymeric skin engaging member immovably affixed adjacent said blade, said skin engaging member being a unitary polymeric member comprising a rigid or semi-rigid inner polymeric layer surrounded by a flexible, elastomeric outer layer, said outer layer having an interrupted skin-engaging surface, said inner layer extending axially through said outer layer and providing mechanical strength to said skin engaging member.

2. The shaving unit of claim 1 wherein said outer layer exhibits a hardness of about 27 to about 75 on the Shore A scale.

3. The shaving unit of claim 1 or 2 wherein said outer layer comprises an elastomer selected from styrene elastomer, polyolefin elastomer, polyamide elastomer, polyester elastomer, polyurethane elastomer, and combinations thereof.

4. The shaving unit of claim 1 or 2 wherein said outer layer comprises an elastomer selected from styrene-ethylene/butylene-styrene block copolymer, crosslinked ethylene propylene diene monomer (EPDM)/propylene, polypropylene/butyl rubber, polypropylene/butyl rubber/ethylene vinyl acetate, and combinations thereof.

5. The shaving unit of claim 1 or 2 wherein said inner layer comprises a polymer selected from polypropylene, polyethylene, polystyrene, high impact polystyrene, nylon, polyethylene terephthalate (PET), acetal resins, and combinations thereof.

6. The shaving unit of claim 1 or 2, wherein said outer layer further comprises a material selected from a plasticizer, a beard softener, a lubricant, a shaving aid, a filler, a tackifier, a fragrance, an antipruritic/counterirritant, an antimicrobial/keratolytic, an inflammatory, an astringent, a surfactant, a compatibilizer, a blowing agent, and combinations thereof.

7. The razor cartridge of claim 1, wherein the skin-engaging surface comprises ribs.

8. The razor cartridge of claim 1, wherein the skin-engaging surface comprises grooves.

9. The razor cartridge of claim 1, wherein the skin-engaging surface comprises dimples.

10. The razor cartridge of claim 1, wherein the skin-engaging surface comprises nubs.

* * * * *